United States Patent [19]

Hall et al.

[11] 4,415,612

[45] Nov. 15, 1983

[54] DOUBLE ENGRAVED IDENTIFICATION CARD

[75] Inventors: John S. Hall; Barry C. Phelps, both of Sacramento, Calif.

[73] Assignee: California Interface and Software Limited Partnership, Sacramento, Calif.

[21] Appl. No.: 338,788

[22] Filed: Jan. 11, 1982

[51] Int. Cl.[3] ..... B44F 1/10

[52] U.S. Cl. ..... 428/29; 428/30; 428/172; 428/203; 428/204; 283/75; 283/94; 283/111

[58] Field of Search ..... 428/30, 172; 40/2.2, 40/626, 630, 910; 430/10, 15, 257; 283/7, 75, 91, 94, 110, 111

[56] References Cited

U.S. PATENT DOCUMENTS 3,412,493 11/1968 French ..... 40/2.2
3,897,964 8/1975 Oka et al. ..... 283/7
3,930,924 1/1976 Oka et al. ..... 156/268
3,950,608 4/1976 Noda et al. ..... 178/6.6 B

*Primary Examiner*—George F. Lesmes
*Assistant Examiner*—P. R. Schwartz
*Attorney, Agent, or Firm*—Nilsson, Robbins, Dalgarn, Berliner, Carson & Wurst

[57] ABSTRACT

A double engraved identification card has a first planar member with a first engraved image in one of its major planar surfaces and a second planar member with a second engraved image in one of its major planar surfaces. The first and second engraved images are aligned in coincidence and the first and second planar members affixed to one another so as to form a single composite image. A slot is provided between the first and second planar members between the first and second engraved images. The slot has an edge access opening to selectively receive an opaque card through the edge opening into the slot region and prevent simultaneous observation of both the first and second engraved images.

12 Claims, 4 Drawing Figures

DOUBLE ENGRAVED IDENTIFICATION CARD

BACKGROUND OF THE INVENTION

This invention relates to machine engraved identification cards and in particular to a double layered identification card where each layer has an image engraved thereon.

Engraved identification cards and the method of making them utilizing available electronic engraving systems is known. For example, engraved identification cards and the method of making them is disclosed in Oka, et al., U.S. Pat. No. 3,897,964 and Oka, et al., U.S. Pat. No. 3,930,924. Typical electronic systems for engraving cards are disclosed in Noda, et al., U.S. Pat. No. 3,950,608 and Wada et al., U.S. Pat. No. 4,052,739. Utilizing an electronic engraving system such as that described in the Noda and Wada patents, an identification card blank is engraved by making a multiplicity of "V" shaped scores through one opaque colored plastic layer of the card blank into a second different colored opaque plastic layer of the card blank. By altering the depth of the "V" shaped scoring, the width of the region between scores can be continuously varied to generate lignt and dark regions which, when viewed as a composite, form the desired image.

While the above described engraved identification cards provide improved security against forgery, there is a continuing need to further increase security by increasing the difficulty and expense required to forge such identification cards. The present invention provides such an improved security identification card by engraving an identical image on each of two different planar members and then affixing the two planar members together with, for example, a suitable adhesive or a heat bond so that the two engraved images are aligned and appear as a single or composite image to the viewer. A slot or space may be provided between the two engraved planar members with an edge opening to enable insertion of an opaque card between the two engraved images to thereby mask one of the images and prevent the simultaneous viewing of both images. Security is increased because it is necessary to engrave two cards in such a way that the images will align.

Yet another advantage of the double engraved identification card is that the resultant composite image gives the illusion of the depth. Consequently, the viewed composite image appears more realistic than engraved images on prior engraved identification cards.

SUMMARY OF THE INVENTION

A double engraved identification card includes a first planar member having a first major surface with a first image engraved thereon and a translucent second planar member having a first major surface with a second image engraved thereon. The first and second engraved images on the first and second planar members are aligned so as to coincide and appear to an observer as a single composite image. Such a composite image may be formed by providing an identical engraved image on each of the two planar members and then affixing the two planar members to one another with the non-engraved side of one planar member being positioned adjacent to the engraved side of the other planar member. Alternatively, the first and second engraved images may be mirror images of one another in which case the engraved surface of the first and second planar members are aligned in facing relationship to each other.

The first planar member may be a laminated structure having a first ply with a first color and a second ply with a second color with contrasts with the first color whereby the first engraved image is formed by engraving through the first ply into the second ply.

In the embodiment where the engraved surfaces are positioned in facing relationship to one another, the first engraved image is the mirror image of the second engraved image to assure the necessary pictorial coincidence.

Finally, a slot may be provided between the first and second planar members for receiving an opaque card to mask one of the engraved images whereby only one of the engraved images can be observed.

BRIEF DESCRIPTION OF THE DRAWINGS

A complete understanding of the present invention and of the above and other advantages and features thereof may be gained from a consideration of the following description of the preferred embodiments taken in conjunction with the accompanying drawings in which.

DETAILED DESCRIPTION

The present invention is an improved security identification card which includes two planar members each engraved with an image and affixed to one another so that the two engraved images are transversely aligned thereby forming a single observable image. A slot may be provided between the two planar members adjacent the transversely aligned engraved images so that an opaque planar member, such as a black card, can be inserted between the two engraved images thereby allowing only one of the images to be observed.

Figure 1:
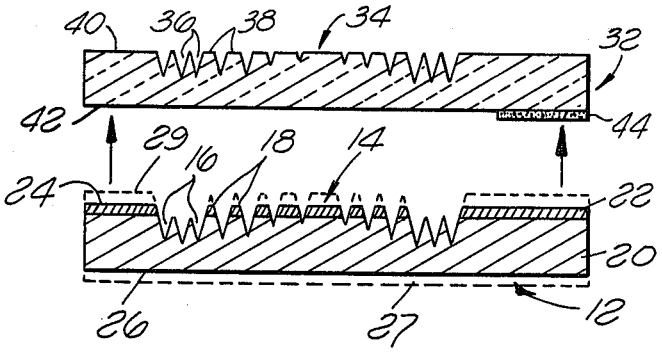
FIG. 1 is an exploded cross-sectional side view of the double engraved identification card in accordance with one embodiment of the invention.
Figure 2:
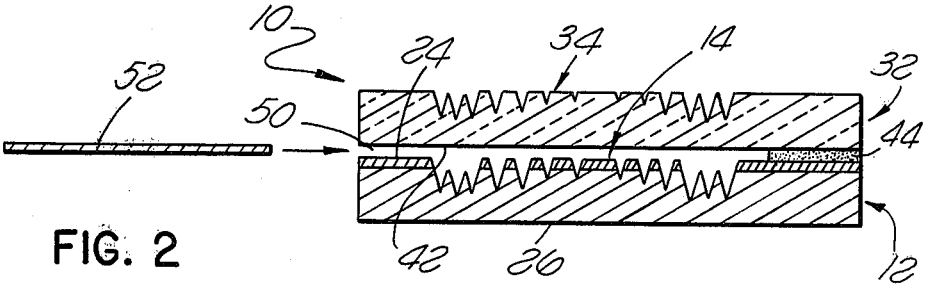
FIG. 2 is a cross-sectional side plan view of the double engraved identification card of FIG. 1 in an assembled configuration.
Figure 3:
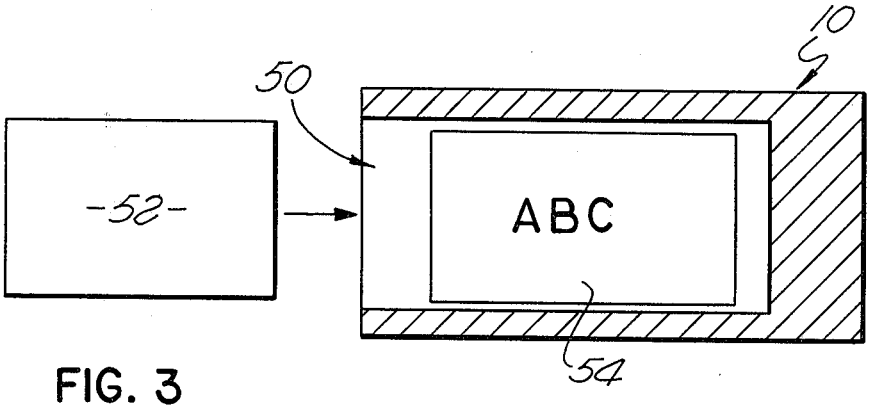
FIG. 3 is a top view of the assembled double engraved identification card of FIGS. 1 and 2.

Referring to FIGS. 1, 2 and 3, the improved security identification card in accordance with the invention comprises a first planar member 12 having a first image 14 engraved in a first surface 24. The first image 14 is formed by a plurality of variable width engraved regions 16 and a plurality of non-engraved variable width regions 18 distributed over the first surface 24 so as to form an image.

The construction of the first planar member 12 may be in accordance with the disclosure in Oka, et al., U.S. Pat. No. 3,897,964 and Oka et al., U.S. Pat. No. 3,930,924 in which case the first planar member 12 includes a first opaque ply 20 overlaid with a second opaque ply 22 with the engraving being performed through the second opaque ply 22 into the first opaque ply 20 utilizing any of a number of available electronic engraving systems such as that disclosed in Noda, et al., U.S. Pat. No. 3,950,608 or Wada et al., U.S. Pat. No. 4,052,739.

Alternatively, the first planar member 12 may be provided with an engraved image as described in my copending patent application entitled "Latent Image Identification Card" Ser. No. 06/303,349 which application is herein incorporated by reference.

In still another alternative embodiment, the first planar member 12 may be constructed in accordance with my copending patent application entitled "Engraved Image Identification Card with Opaque Cover Layer" Ser. No. 06/330,348 which application is herein incorporated by reference.

In accordance with the above patent applications, the first planar member 12 may have any of a number of configurations. For example, the first planar member 12 may consist of two plies where one ply is opaque and the other ply is a colorless translucent member. In another example, the first planar member 12 may consist of three plies where a third ply 29 is an opaque colored ply (e.g., black) positioned on top of and in coincidence with the second ply 22 which is at least semi-opaque and of a different color (e.g., white) with the first ply 20 being translucent.

In yet another alternative arrangement, the second ply 22 can be eliminated and a single opaque ply 27 affixed to the second surface 26 of the first ply 20 where the first ply 20 is translucent. Various other configurations of the first planar member 12 are possible without departing from the spirit of the present invention in its broadest aspects.

In addition to the first planar member 12, the present double engraved identification card includes a second planar member 32 having a first surface 40 with an engraved image 34 formed therein by variable width engraved regions 36 and variable width non-engraved regions 38. The second planar member 32 also has a second surface 42 which in one embodiment is positioned adjacent to the first surface 24 of the first planar member 12.

The first and second planar members 12 and 32, which may be affixed together using a suitable adhesive 44, is applied to selected regions of either the first planar member 12 or the second planar member 32. The adhesive 44 may be any adhesive which will bond the materials out of which the first and second planar member 12 and 34 are made and is preferably a translucent colorless adhesive.

Referring more particularly to FIGS. 2 and 3, in accordance with one embodiment of the invention, the adhesive 44 is applied in only specified regions between the first and second planar members 12 and 32 so that a slot 50 remains between the second surface 42 and the first surface 24 transversely between the engraved images 14 and 34.

In accordance with one unique feature of the present invention, an opaque card 52 such as a thin piece of paper or plastic will cover and therefore mask the first engraved image when it is inserted in the slot 50. The validity of the card can be confirmed because the insertion of the opaque card 52 does not mask the second engraved image 34 in the second planar member 32 so that an image will still be observed.

Of course, it will be appreciated that if the first planar member 12 is transparent, the insertion of the opaque card 52 into the slot 50 will allow the first engraved image 14 to be viewed from the back of the first planar member 12 through the second surface 26. In that instance, the second engraved image will be masked from view.

As illustrated in FIG. 3, when the opaque masking card 52 is not in place in slot 50, a composite image 54 comprised of the overlaid and transversely aligned first and second engraved images 14 and 34 will be observed by a viewer. On the other hand, when the opaque masking card 52 is inserted into the slot 50, an image will still be observed but the image observed will not be a composite image but rather will be either the first engraved image 14 or the second engraved image 34 depending on the side of the double engraved identification card 10 from which viewing occurs.

Figure 4:
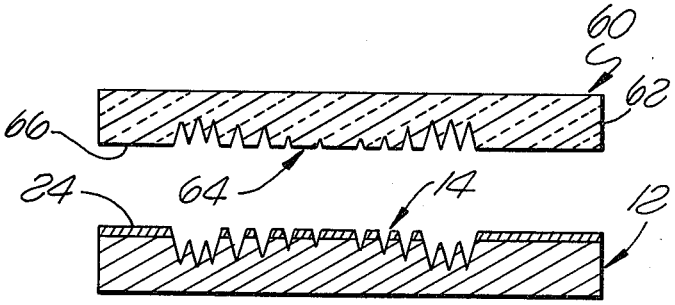
FIG. 4 is an exploded side plan view of a mirror image embodiment of a double engraved identification card in accordance with the invention.

Referring to FIG. 4, an alternative double engraved identification card 60 in accordance with the invention is illustrated which includes the first planar member 12 as previously described in conjunction with FIGS. 1 through 3 and a second planar member 62 having a first surface 66 in which a second image 64 is engraved. The engraved image 64 is the mirror image of the first engraved image 14. The second planar member 62 is then affixed to the first planar member 12 with the first surface 66 of the second planar member 62 facing the first surface 24 of the first planar member 12. Thus, the engraved images are in facing relationship but because the second engraved image 64 is the mirror image of the first engraved image 14, the two images will coincide and appear as a single composite image when the first planar member 12 is aligned with the second planar member 62. In all other respects, the construction of the embodiment shown in FIG. 4 is substantially the same as the construction of the embodiment illustrated in FIGS. 1 through 3.

While specific embodiments of the present invention have been described above, it will be appreciated that various changes may be made without departing from the true spirit of the present invention and it is the object of the following claims to encompass all such modifications and variations as are within the true spirit and scope of the invention.

What is claimed is:

1. A double engraved identification card for use with an opaque masking member comprising:

a first planar member having a first major surface with a first image engraved thereon and a second major surface opposite the first major surface;

a translucent second planar member having a first major surface with a second image engraved thereon, and a second major surface opposite the first major surface, the second engraved image coinciding with the first engraved image when the second planar member is aligned with the first planar member; and means for affixing the first and second planar members together with the first and second engraved images in coincidence whereby a slot is provided between the first and second planar member transversely adjacent the first and second engraved images for removeably receiving the opaque planar member in the slot for masking one of the first and second engraved images from view.

2. The double engraved identification card of claim 1 wherein the first planar member is a laminated dual ply member comprising:

a first ply having a first color, and a second ply having a second color which contrasts with the first color, the first engraved image being formed by engraving through the first ply into the second ply.

3. The double engraved identification card of claim 2 wherein at least one of the first and second plys is opaque.

4. The aligned double engraved identification card of claims 1, 2 or 3 wherein the second engraved image is the mirror image of the first engraved image and the first major surfaces of the first planar member and the translucent second planar member are positioned in facing relationship to each other.

5. The aligned double engraved identification card of claims 1, 2 or 3 wherein the second major surface of the translucent second planar member is positioned adjacent the first major surface of the first planar member with the first and second engraved images having the same optical orientation relative to each other whereby the first and second engraved images are transversely aligned.

6. The double engraved identification card of claim 1 wherein the first planar member is laminated and comprises:

a first translucent ply, and a second colored ply affixed opposite the engraved first major surface.

7. The double engraved identification card of claim 6 wherein the second colored ply is opaque.

8. A double engraved identification card comprising:

a first planar member having a first major surface with a first image engraved thereon, and a second major surface opposite the first major surface;

a translucent second planar member having a first major surface with a second image engraved thereon, and a second major surface opposite the first major surface, the second engraved image coinciding with the first engraved image when the second planar member is aligned with the first planar member; and means for affixing the first and second planar members together with the first and second engraved images in coincidence.

9. The double engraved identification card of claim 8 wherein the first planar member is a laminated dual ply member comprising:

a first ply having a first color, and a second ply having a second color which contrasts with the first color, the first engraved image being formed by engraving through the first ply into the second ply.

10. The double engraved identification card of claim 9 wherein at least one of the first and second plys is opaque.

11. The double engraved identification card of claims 8, 9, or 10 wherein the second engraved image is the mirror image of the first engraved image and the first major surfaces of the first planar member and the translucent second planar member are positioned in facing relationship to each other.

12. The double engraved identification card of claims 8, 9 or 10 wherein the second major surface of the translucent second planar member is positioned adjacent the first major surface of the first planar member with the first and second engraved images having the same optical orientation relative to each other whereby the first and second engraved images are transversely aligned.

* * * * *